US006598770B2

(12) United States Patent
Bolts

(10) Patent No.: US 6,598,770 B2
(45) Date of Patent: Jul. 29, 2003

(54) BEVERAGE CONTAINER BELT

(76) Inventor: Lorita Bolts, 2524 Buena Vista Ave., Corona, CA (US) 92882

( * ) Notice: Subject to any disclaimer, the term of this patent is extended or adjusted under 35 U.S.C. 154(b) by 50 days.

(21) Appl. No.: 09/992,403

(22) Filed: Nov. 19, 2001

(65) Prior Publication Data

US 2003/0094469 A1 May 22, 2003

(51) Int. Cl.[7] ..... A45F 3/20; A45F 5/00

(52) U.S. Cl. ..... 224/148.2; 224/148.4; 224/148.5; 224/162

(58) Field of Search ..... 224/148.2, 148.4, 224/148.5, 162, 660, 662; 2/94, 312; 242/404.1, 588.1, 588.2

(56) References Cited

U.S. PATENT DOCUMENTS

| | | | | | |
|---|---|---|---|---|---|
| 4,090,650 | A | * | 5/1978 | Gotta | 224/148.2 |
| 4,139,130 | A | * | 2/1979 | Glusker et al. | 2/312 |
| 4,176,772 | A | * | 12/1979 | Danon | 224/148.5 |
| 5,104,016 | A | * | 4/1992 | Runkel | 224/148.5 |
| 5,282,557 | A | * | 2/1994 | McCook | 224/148.2 |
| 5,571,260 | A | * | 11/1996 | Krug | 224/660 |
| 5,755,368 | A | * | 5/1998 | Bekkedahl | 224/148.2 |
| 5,971,238 | A | * | 10/1999 | Malvasi et al. | 242/588.1 |
| 5,984,145 | A | * | 11/1999 | McAllister | 224/148.2 |
| 6,199,729 | B1 | * | 3/2001 | Drzymkowski | 224/148.2 |
| 6,220,490 | B1 | * | 4/2001 | O'Hara | 224/148.2 |
| 6,349,844 | B1 | * | 2/2002 | Betras | 224/148.4 |
| 6,382,481 | B1 | * | 5/2002 | McIlmoil | 224/162 |
| 6,409,048 | B1 | * | 6/2002 | Belzeski | 224/148.4 |
| 6,419,413 | B1 | * | 7/2002 | Oliver et al. | 224/162 |
| 2002/0113101 | A1 | * | 8/2002 | Skillern | 224/148.2 |

* cited by examiner

*Primary Examiner*—Gary E. Elkins
(74) *Attorney, Agent, or Firm*—Michael I. Kroll

(57) ABSTRACT

A portable liquid container is provided wherein an elongated, flexible container is filled with a beverage through a closable filling orifice, and the container is belted on a user using belt end fasteners, e.g. hook-and-loop material. The user grasps a nozzle on the end of an flexible, extendable straw that is stored and wound within a spring-loaded winder mechanism attached to the surface of the container. Pulling on the nozzle causes the straw to extend sufficiently to reach the user's mouth. When finished, the user allows the straw to be rewound into the winder mechanism. A collecting member with an intake positioned low within the container delivers beverage to a mating member that establishes fluid communication between the collecting member and the straw. A color-coded temperature gauge and liquid level indicator are attached to the container. An isolating member is also provided between the user and the container.

20 Claims, 11 Drawing Sheets

BEVERAGE CONTAINER BELT

BACKGROUND OF THE INVENTION

Field of the Invention

The present invention relates generally to beverage containers and, more specifically, to a beverage container that may be selectively fastened and secured around the waist of an individual.

SUMMARY OF THE PRESENT INVENTION

A primary object of the present invention is to provide a beverage container that may be fashionably worn as a belt.

A second object of the present invention is to provide a beverage container that can be worn to improve the user's balance, particularly child users.

Another object of the present invention is to provide a beverage container that may replace conventional beverage containers.

Yet another object of the present invention is to provide a beverage container that may provide the user of the beverage container with a temperature monitoring system.

Still yet another object of the present invention is to provide a beverage container that may act as a weighted device to assist in the workout routine of the user or to provide beverages during outside activities, such as an amusement park, zoo, horseback riding, bike riding, roller skating, boating, or and the like.

Yet another object of the present invention is to provide a beverage container that has a detector window to monitor the consumption of the beverage within the beverage container belt.

Additional objects of the present invention will appear as the description proceeds.

The present invention is a beverage container belt. The beverage container belt consists of a beverage container housing and two belt strap ends with fastening means. The belt straps are located one at each of the distal ends of the beverage container housing.

The belt straps may be of a sturdy yet pliable fabric that consists of mating hook-and-loop material. The belt straps provide the user of the beverage container belt with the means for securing the beverage container belt around the waist.

The beverage container housing is an elongated and flexible structure that provides the beverage storage means for the beverage container belt.

The container housing consists of a filling plug, a filling orifice, an isolating element, a fluid level indicator, a temperature indicator, and a straw with a winder mechanism. The filling plug provides the means for retaining a fluid once it has been placed into the beverage container belt via the filling orifice. The filling orifice is an aperture that provides the mating means for the filling plug as they work in conjunction to retain any fluid placed within the beverage container belt.

The isolating element is a pliable, water resistant, and temperature retardant strip of fabric that may provide the means for preventing the body heat of the user from changing the temperature of the fluid or beverage being stored within the beverage container belt.

The fluid level indicator is a transparent element furnished with measurement marking means and located on the front most end of the beverage container belt at one of its distal ends. The fluid level indicator provides the user of the beverage container belt with the means for monitoring the contents being stored within the beverage container belt.

The temperature indicator resembles that of a conventional thermometer that displays the temperature as a color, the color corresponding to a known temperature range. The temperature indicator provides the user of the beverage container belt with the means for monitoring the temperature of the fluid or beverage contents being stored within the beverage container belt. The temperature indicator is also located on the front most end of the beverage container belt.

The winder mechanism is a spring loaded unit that is located on the front most end of the beverage container belt at the distal end opposite the level and temperature indicators. The winder mechanism provides the user of the beverage container belt with the means of selectively extending or rewinding the retractable straw.

The winder mechanism includes a nozzle, a selectively extendible straw, a winder mechanism housing, a collecting member, a spool plate, and a coiled spring. The winder mechanism housing provides the housing means for all of the components that comprise the winder mechanism.

The nozzle is a cone shaped structure that protrudes from the extendible straw. The extendible straw is an elongated straw coiled within the winder mechanism housing. The extendible straw provides the user of the beverage container belt with the means for hands-free drinking.

The extendible straw in turn is positioned for free spinning with respect to the beverage container housing as the extendible straw is extended from the winder mechanism housing.

The collecting member is an L-shaped cylindrical structure that is positioned within the beverage container housing and provides the means for extracting substantially all of the fluids/or beverage being stored within the lowest point of the beverage container belt.

The user of the beverage container belt fills and then secures the beverage container belt around his or her waist. With the beverage container belt in place and using the extendable retractable straw the individual may now carry on with a full range of physical activities without the hindrance of having to stop or locate a conventional beverage container.

A portable liquid container is provided that comprises: an elongated, flexible container, the container having a passage for receiving liquids, and a closing member for closing the passage, the container further having a first end and a second end, the first and second ends having fastening members for fastening the first end to the second end such that the container may be belted about a user; a hollow mating member having a first end, the first end having an opening positioned within the container, and a second end, the second end having an opening positioned outside the container; a hollow collection member positioned within the container, the collection member having a first end and a second end, the first end being positioned within the container to receive liquids from within the container, the collection member second end being mated with the mating member for liquid passage through the mating member; an extendable and flexible straw having a first end and a second end, the first end being mated with the mating member for liquid passage into the straw, the straw first end being rotatable with respect to the mating member; and a winder mechanism positioned on the container, the winder mechanism receiving the straw from the mating member, coiling the straw within the winder mechanism, and discharging the straw second end from within the winder mechanism, the winder mechanism allowing the straw to be uncoiled and extended beyond the winder mechanism, the winder mechanism having a spring for rewinding the extended straw within the winder mechanism.

In another embodiment, the container further comprises a layer of heat insulating material attached to the container and positioned such that the material is between the container and the user when the container is belted about the user.

In another embodiment, the container further comprises a temperature gauge attached to the container, the gauge indicating the temperature of the contained liquids.

In another embodiment, the temperature gauge further comprises at least two color indicators for indicating the liquid temperature.

In another embodiment, the number of color-coded indicators is four, the indicators comprising a red, yellow, green and blue indicator.

In another embodiment, the container further comprises a fluid level indicator, the fluid level indicator indicating the level of the contained liquids.

In another embodiment, the container is constructed from a heat insulating material.

In another embodiment, the container further comprises a liner, the liner being impermeable with respect to liquid.

In another embodiment, the liner is constructed from a heat insulation material.

In another embodiment, the container first and second end fastening members comprise a first hook-and-loop fastener portion and a second hook-and-loop fastener portion.

In another embodiment, the container further comprises a nozzle attached to the straw second end.

In another embodiment, the container further comprises a bottom portion, the collection member first end being positioned within the container bottom portion.

In another embodiment, the winder mechanism further comprises: a housing the housing having an entry passage for receiving mating member second end, the housing having an exit passage for receiving the straw; a coil spring having a first end and a second end, the first end attached to the housing; and a spool plate attached to the coil spring second end such that rotation of the spool plate winds the coil spring, the spool plate having a spool portion, the spool plate further having a passage, such that the straw is received through the spool plate passage, wound upon the spool portion, and discharged through the housing exit passage.

In another embodiment, the straw first end further comprises an enlarged portion; and the mating member further comprises an enlarged interior for receiving the straw first end enlarged portion for rotation therein.

A portable liquid container is provided comprising: an elongated, flexible container, the container having means for adding liquid within the container, and means for belting the container about the waist of the user; means for providing liquid passage into an extendable and flexible straw, the straw being rotatable with respect to the container; and means for extending the straw to the user's mouth and retrieving and coiling the straw upon completion of use by the user.

In another embodiment, the container further comprises means for reducing heat transfer between the container and the user's body.

In another embodiment, the container further comprises means for measuring and communicating the temperature of the liquid within the container to the user.

In another embodiment, the container further comprises means for communicating the amount of liquid remaining in the container to the user.

In another embodiment, the container further comprises means for reducing heat transfer between the liquids in the container and the environment about the container.

In another embodiment, the container further comprises means for reducing heat transfer between the liquids in the container and the container.

The foregoing and other objects and advantages will appear from the description to follow. In the description, reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a pictorial view of the present invention. Shown is an individual engaging in a daily work out, while enjoying a cool refreshing drink from the beverage container belt. Also shown is the direct size and relation ratio as the belt relates to the user. Shown also is the retractable straw in its fully extended position, which renders is functional.

FIG. 2 is a perspective view showing the displacement relations between several of the components that comprise the beverage container belt. Also shown are the displacement relations of the fastening means as they relates to the adjustable belt strap. Shown also are the ideal mating relations of the belt straps having fastening means. Also shown are the displacement relations of the winder mechanism as it relates to the beverage container housing. Shown also are the displacement relations between the temperature indicator and the winder mechanism. Shown also is the filling plug as it relates to the topmost section of the beverage container belt. Also shown is the retractable straw in the retracted position. Shown also is the isolating element as it relates to the container housing of the beverage container belt.

FIG. 3 is a perspective view, showing the displacement relations between several of the intricate components that comprise the beverage container belt. Also shown are the ideal mating relations between the filling plug and the filling orifice. Shown also is the selectively extendible straw in its fully extended position. Also shown is the fastening means in the unfastened position.

Figure 4:
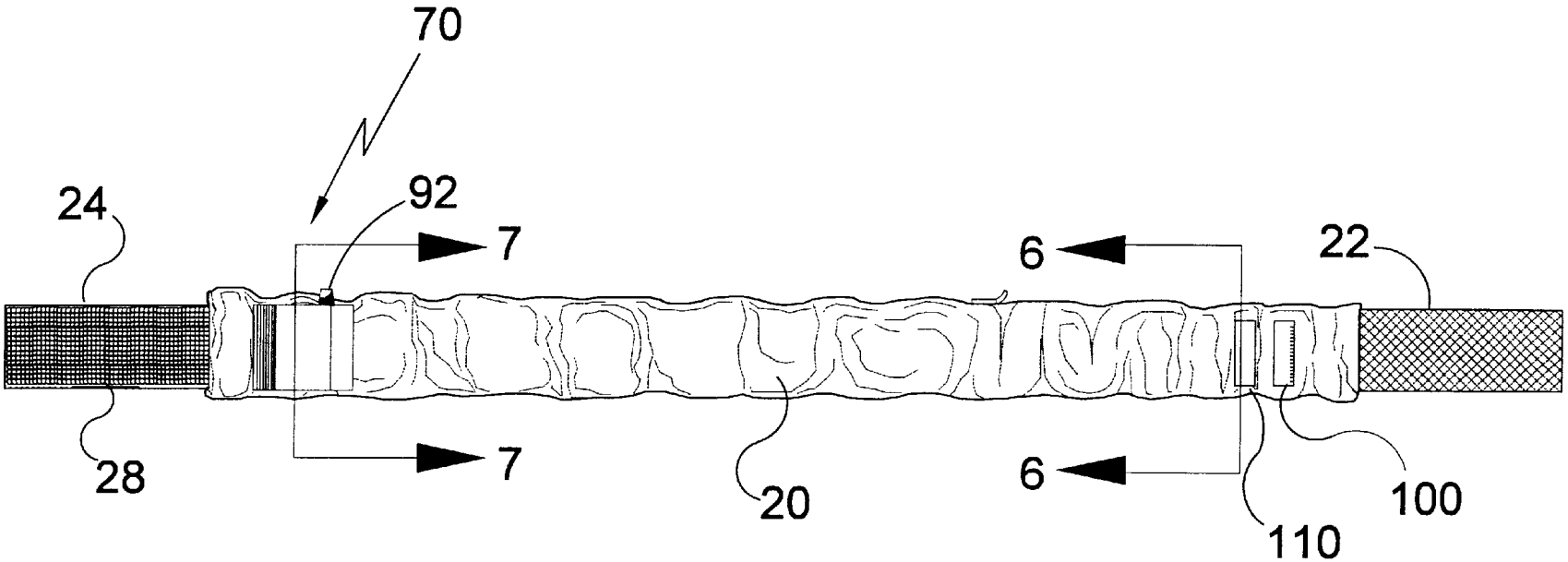
FIG. 4 is a front view, showing the linear displacement relations of the intricate components that are housed on the top most section of the beverage container belt. Also shown are the linear displacement relations of the temperature indicator as it relates to the beverage container housing.
Figure 5:
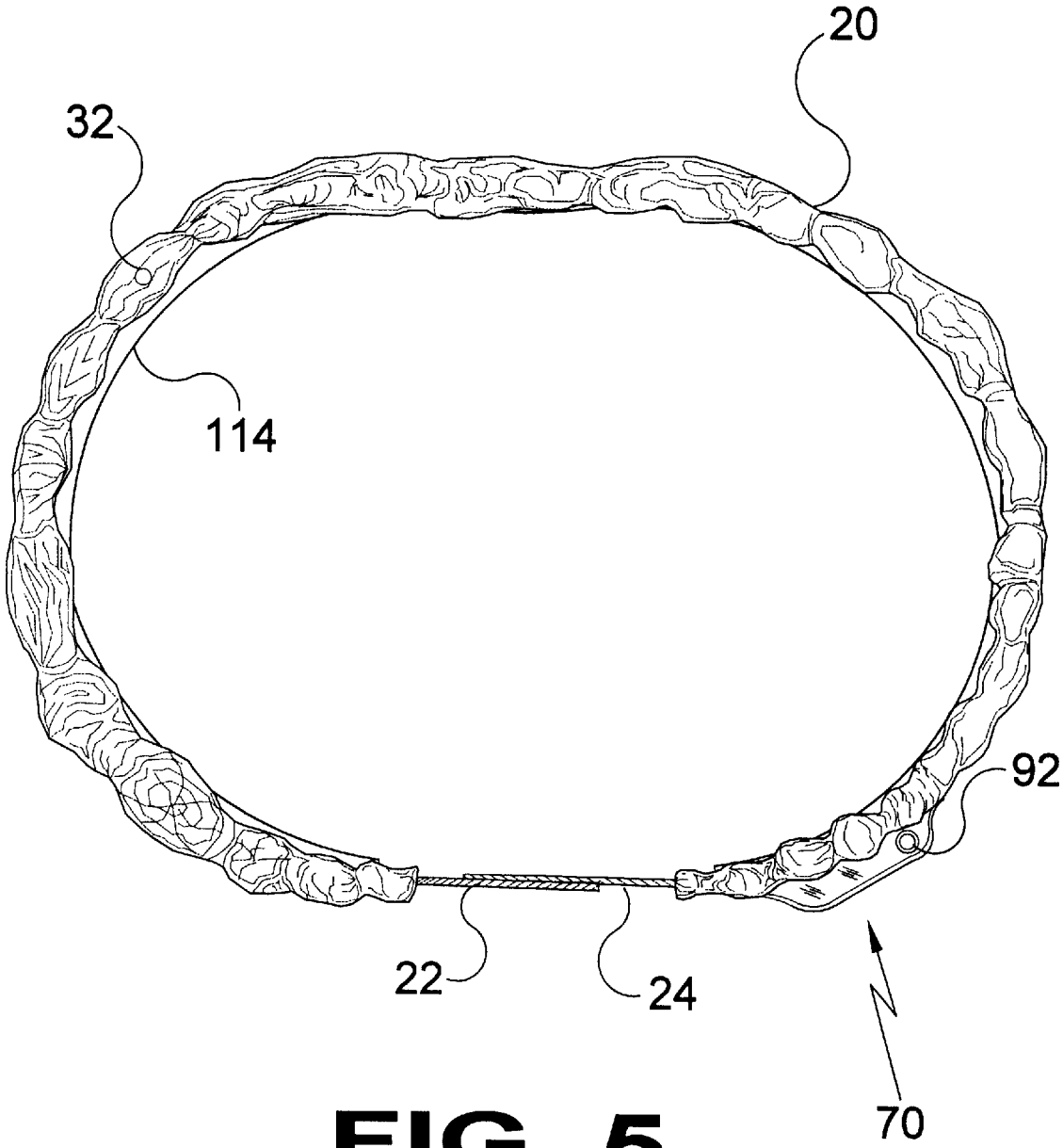
FIG. 5 is a top view, showing the linear displacement relations of the intricate components that are housed on the top most section of the beverage container belt.
Figure 6:
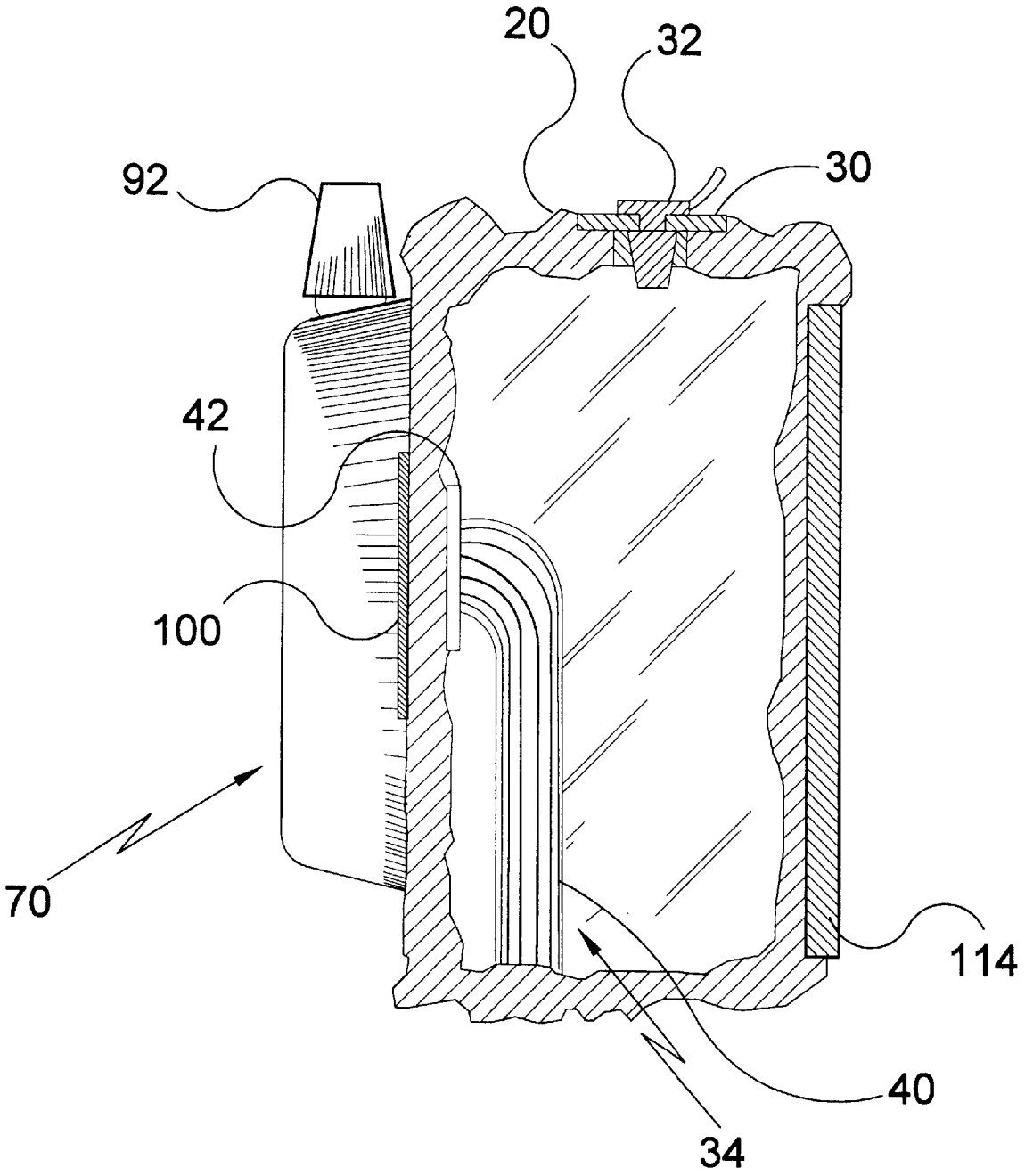

FIG. 6 is a sectional view, taken from FIG. 4 as indicated. Shown are the displacement relations of the temperature indicator, the winder mechanism, the isolating element, and the nozzle as they relate to the outer covering of the beverage container belt. Also shown are the displacement relations of the filling plug, the collecting member, the temperature indicator and the isolating element as they relate of the inner housing of the beverage container belt. Shown also are the coupling relations between the filling plug and the filling orifice as they relate to each other.

Figure 7:
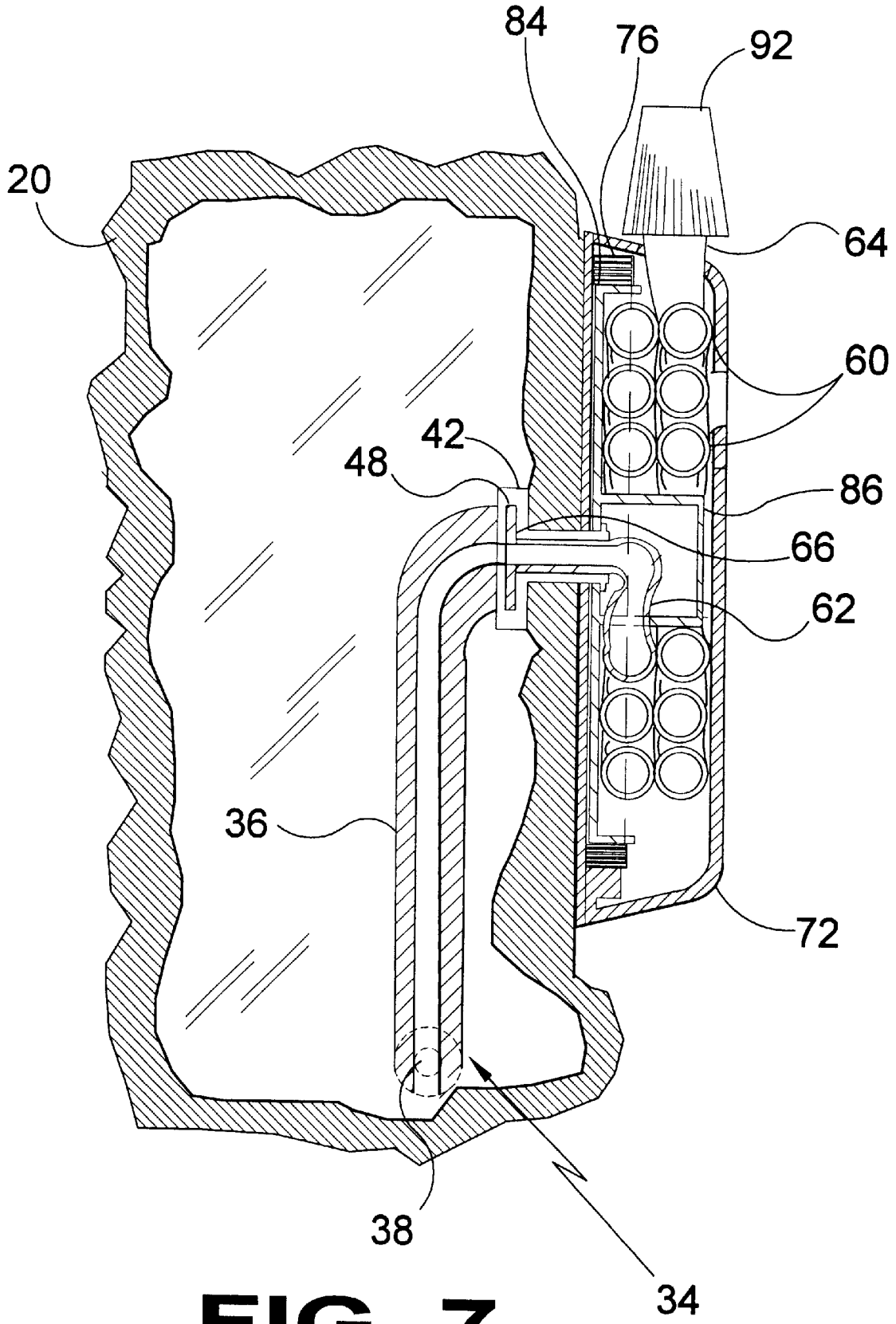

FIG. 7 is a sectional view, taken from FIG. 4 as indicated. Shown are the linear displacement relations of the winder mechanism as it relates to the nozzle, the straw and the mating member. Also shown are the mating relations between the straw and the collecting member. Shown also are the coupling relations between the coil spring as it mates and relates to the winder housing.

Figure 8:
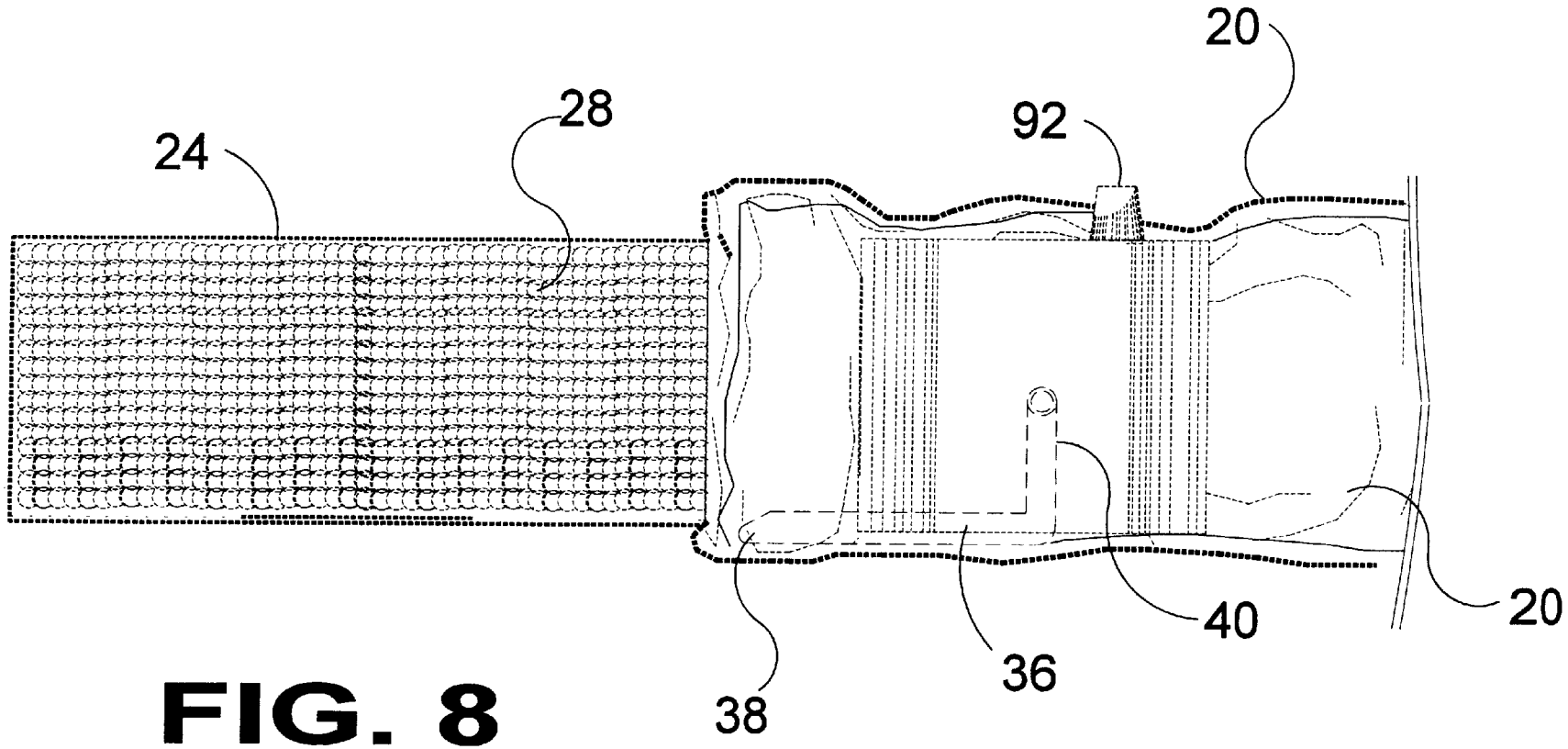

FIG. 8 is a partial front view with portions with portions shown transparently to depict the linear displacement of the collecting member as it relates to the winder mechanism as well as the container housing. Also shown are the displacement relations between the belt strap and the container housing as they relate to the winder housing.

Figure 9:
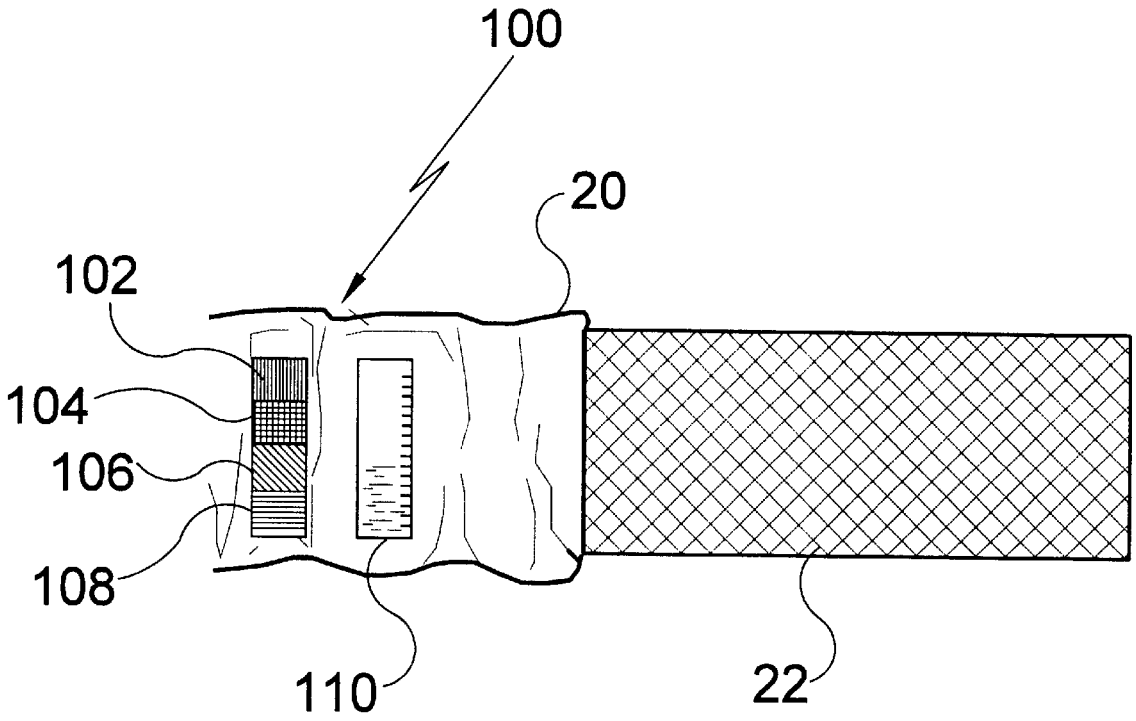

FIG. 9 is a partial view showing the linear displacement of the temperature and fluid level indicator as they relate to each other and the container housing. Also shown is the functional aspect of the temperature indicator as depicted by the color and temperature range variations.

Figure 10:
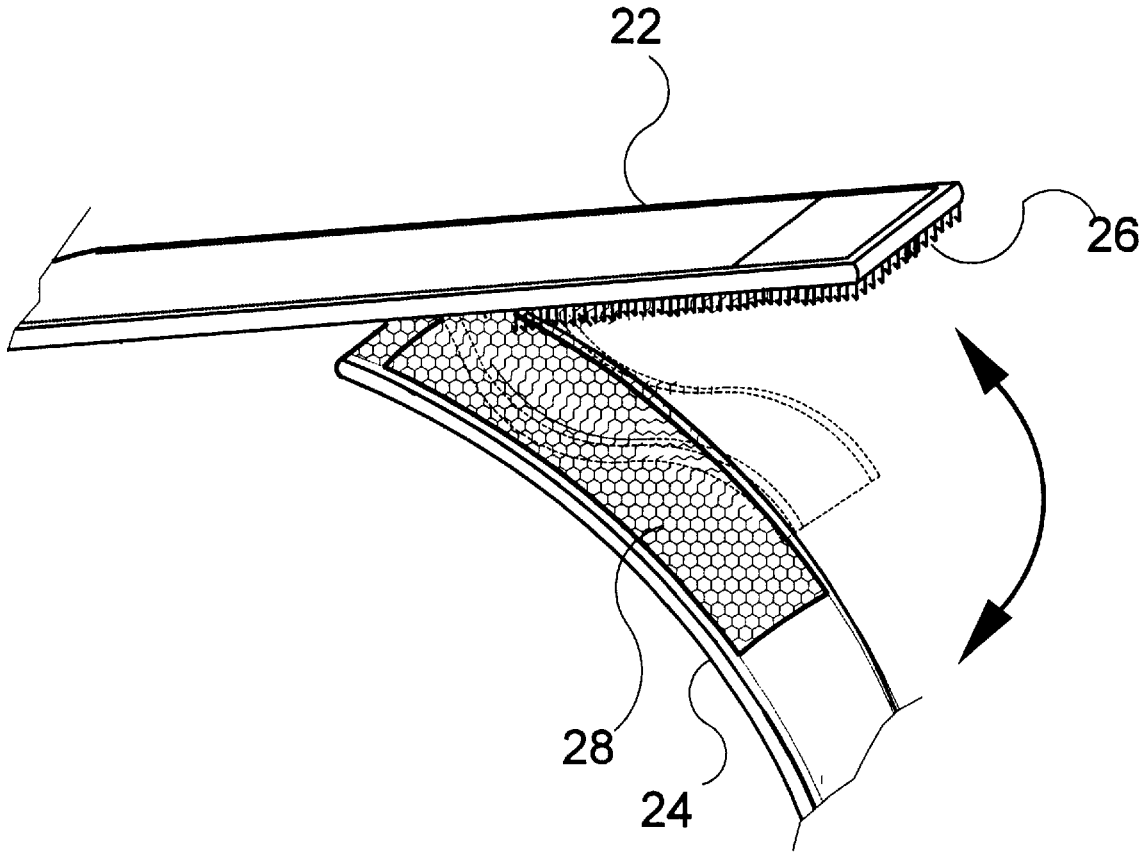

FIG. 10 is a perspective view showing the mating relations of the belt straps.

Figure 11:
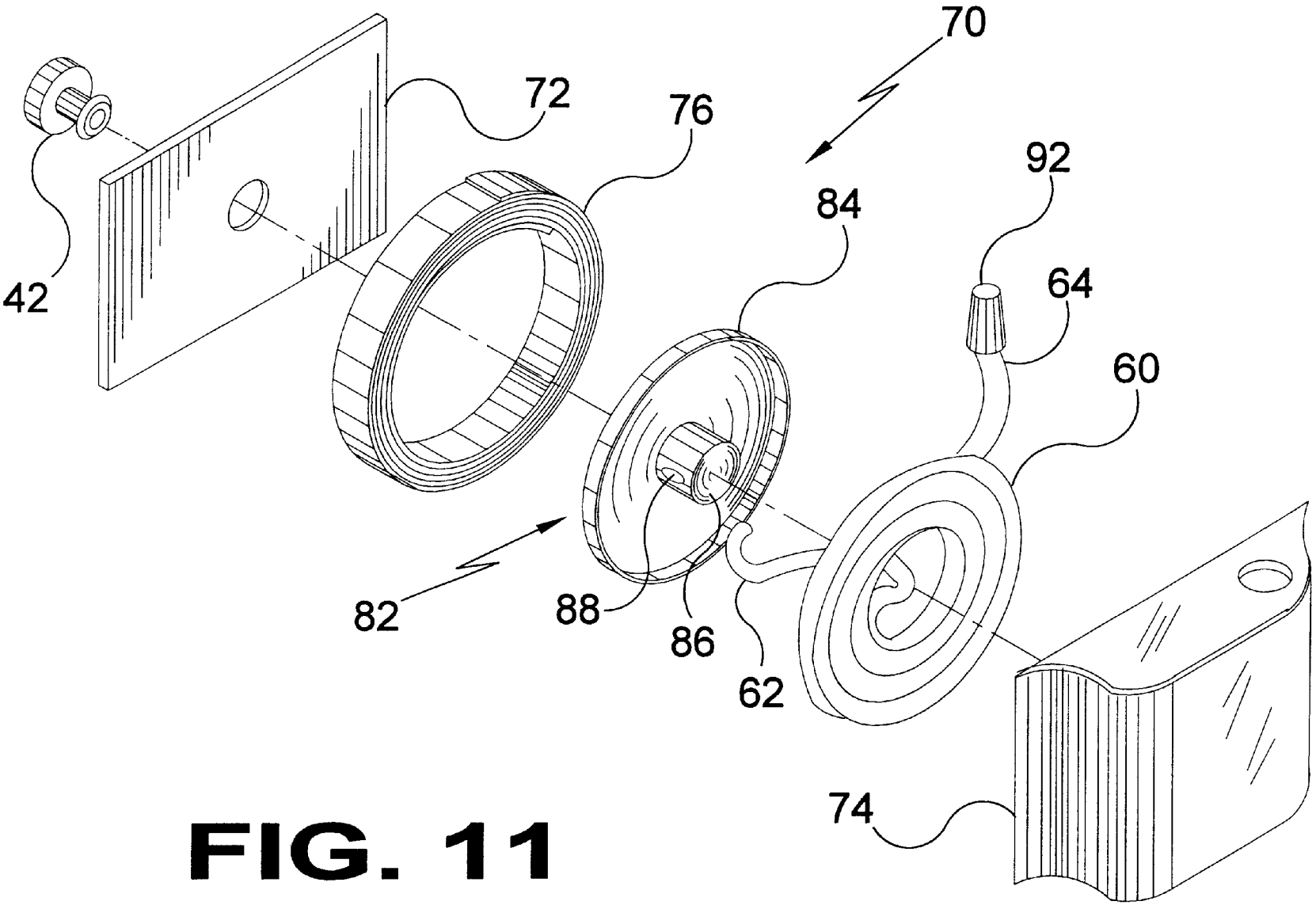

FIG. 11 is an exploded view of the winder mechanism.

DESCRIPTION OF THE REFERENCED NUMERALS

Turning now descriptively to the drawings, in which similar reference characters denote similar elements throughout the several views, the figures illustrate the Beverage Container Belt of the present invention. With regard to the reference numerals used, the following numbering is used throughout the various drawing figures.

10 Beverage Container Belt of the present invention
12 user
20 liquid container
22 container first belt end
24 container second belt end
26 hook-and-loop first portion
28 hook-and-loop second portion
30 filling orifice
32 filling plug
34 collecting member
36 collecting member first portion
38 collecting member first portion opening
40 collecting member second portion
42 mating member
44 mating member first end
46 mating member second end
48 mating member first end enlargement
60 straw
62 straw first end
64 straw second end
66 straw second end enlargement
70 winder mechanism
72 housing back plate
74 housing cover
76 coil spring
78 coil spring first end
80 coil spring second end
82 spool plate
84 spool plate plate portion
86 spool plate spool portion
88 spool plate spool portion aperture
90 housing cover aperture
92 nozzle
100 temperature indicator
102 temperature indicator red indicator
104 temperature indicator yellow indicator
106 temperature indicator green indicator
108 temperature indicator blue indicator
110 liquid level indicator
112 level markings
114 isolating member

DETAILED DESCRIPTION OF THE PREFERRED EMBODIMENTS

Turning now descriptively to the drawings, in which similar reference characters denote similar elements throughout the several views, FIGS. 1–10 illustrate the Beverage Container Belt of the present invention, indicated generally by the numerals 10.

Figure 1:
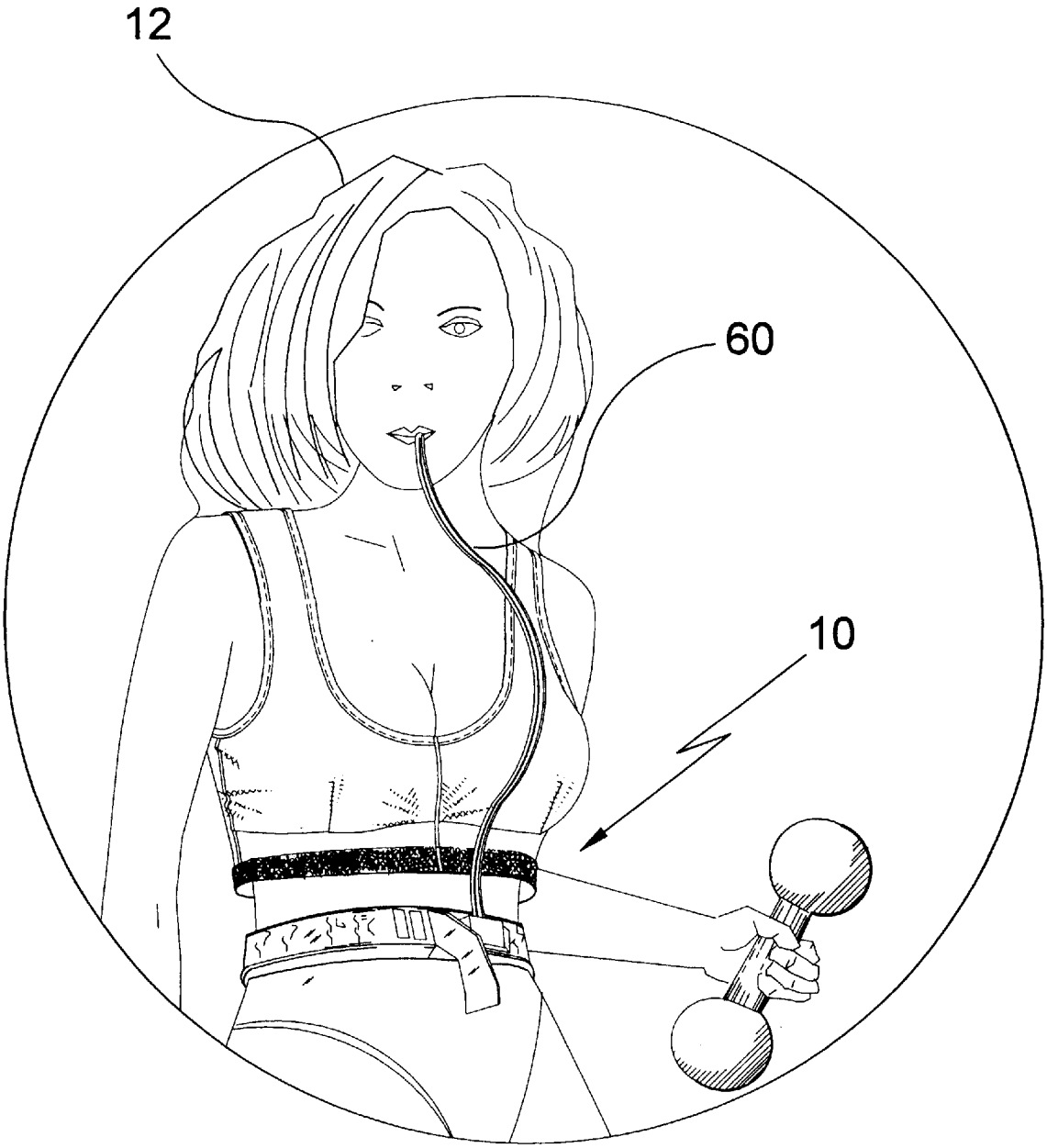

The beverage container belt 10 is shown generally in FIGS. 1–11 and in use by the user 12 in FIG. 1. As shown in FIGS. 1–5, the beverage container belt 10 is generally configured as a belt. The flexible container portion 20 is flexible and has a first end belt strap 22 and a second end belt strap 24, with each having a hook-and-pile portion 26,28. Liquid is added to the container 20 through a filling orifice 30 that is sealed using filling plug 32, as particularly shown in FIGS. 3 and 6.

FIGS. 6–8 depict the positioning of a collecting member 34 that is positioned within the container 20. The collecting member 34 is an L-shaped straw with a first portion 36 that has an opening 38 positioned low in the container 20 to optimize the ultimate drainage of the liquid.

The collecting member 34 has a vertically oriented second portion 40 that bends to mate with a mating member 42. The mating member 42 has a first end 44 and a second end 46, the first end 44 mating with the collecting member second portion 40, for liquid communication through the mating member 42.

A flexible and extendable straw 60 has a first end 62 that receives liquid, and a second end 64 for ultimate delivery of the liquid to the mouth of the user 12. As shown in FIG. 7, the straw first end 62 has a generally planar shaped enlargement 66 that is rotatably positioned and secured within an enlargement 48 in the mating member first end 44. Such positioning allows the straw first end 62 to rotate freely as the straw first end enlargement 66 rotates within the mating member first end enlargement 48. The straw first end enlargement 66 and the mating member first end enlargement 48 can both be replaced by other shapes that act to prevent the withdrawal of the straw first end 62 from the mating member 42, while allowing the straw first end 62 to rotate within the mating member 42.

As shown in FIG. 11, a winder mechanism 70 is attached to the container 20 proximate the mating member 42. The winder mechanism 70 has housing back plate 72 and a housing cover 74, the assembled housing enclosing a coil spring 76. The coil spring 76 has a first end 78 attached to the housing back plate 72, and a second end 80 attached to a spool plate 82 that has a plate portion 84 and a spool portion 86. The spool portion 86 has an aperture 88 for straw 60 passage, the straw 60 then being coiled upon the spool portion 86.

After coiling, the straw second end 64 is presented for exit through an aperture 90 in the housing cover 74. A nozzle 92 is fitted on the protruding straw second end 64.

When the nozzle 92 is proximate the housing cover 74 the coil spring 76 is substantially unwound. As the user 12 pulls the straw 60 from the winder mechanism 70 the coil spring 76 is wound. When the user 12 is finished, the coil spring 76 causes the spool plate 82 to rotate and wind the straw 60 about the spool portion 86. The nozzle 92 prevents the straw second end 64 from being pulled into the housing cover 74.

Figure 2:
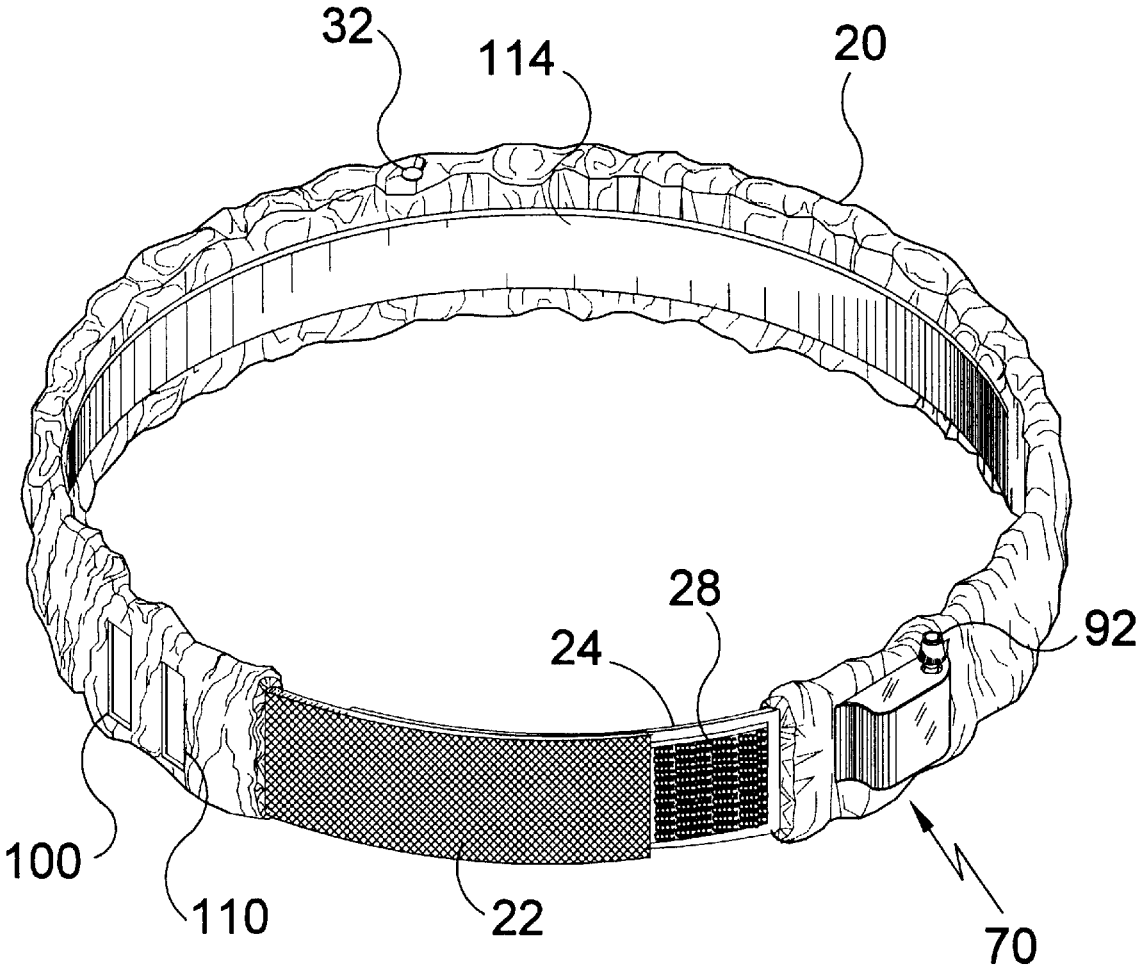
Figure 3:
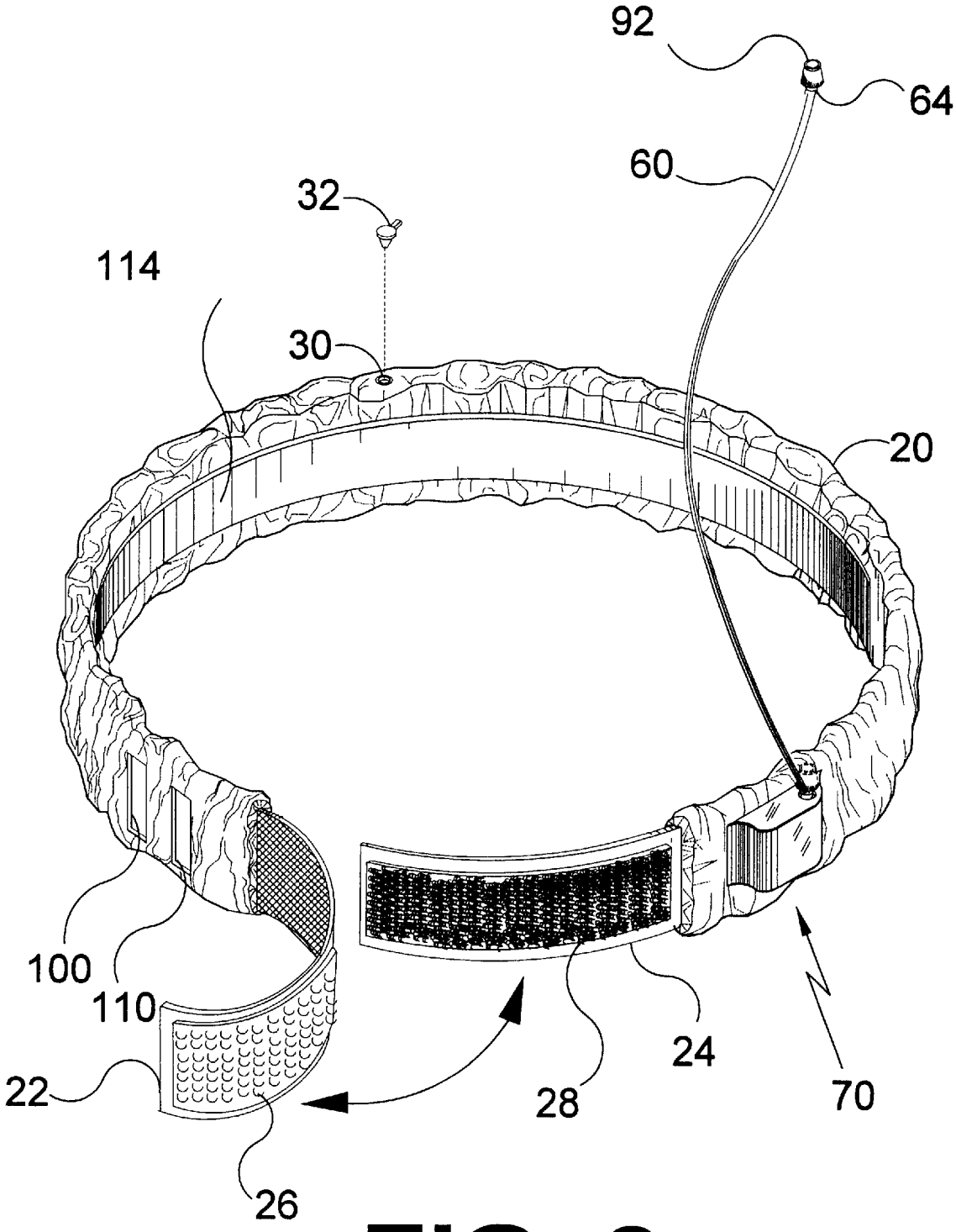

A liquid temperature indicator 100 is shown in FIGS. 2–4, and particularly in FIG. 9. The temperature indicator 100 is attached to the container 20. In the preferred embodiment 10, the temperature indicator 100 includes color indicators that are red 102 for the range 70–80 degrees Fahrenheit, yellow 104 for 40–70 degrees Fahrenheit, green 106 for 20–40 degrees Fahrenheit, and blue 108 for 0–20 degrees Fahrenheit, although other colors and ranges are usable in other embodiments.

A transparent liquid level indicator 110 is also provided and is attached to the container 20 as shown in FIGS. 2–4 and 9. The attached level indicator 110 allows a direct view of the liquid within the container 20. FIG. 9 depicts an example of the level indicator gradations and/or markings 112 that can be used to estimate the remaining volume of liquid within the container 20.

FIGS. 2–3 and 5–6 depict an isolating member 114 that is attached to the container 20 and is positioned to provide a heat transfer and moisture barrier between the user 12 and the container 20. The isolating member 114 is elongated and generally shaped like a conventional belt. The isolating member 114 also adds an element of structural stability.

A liner is also provided within the container that reduces heat transfer between the liquid and the container.

The beverage container belt 10 and its foregoing components can be constructed using various end fasteners and buckles, temperature indicator colors/ranges, liquid level indicator indicia/gradations, container materials and isolating member materials, and can be sized to accommodate users of various sizes, all in accordance with the present invention, and as determined by the intended end use for the overall device, as will occur to those of skill in the art upon review of the present disclosure.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A portable liquid container comprising:

an elongated, flexible container, the container having a passage for receiving liquids, and a closing member for closing the passage, the container further having a first end and a second end, the first and second ends having fastening members for fastening the first end to the second end such that the container may be belted about a user;

a hollow mating member having a first end, the first end having an opening positioned within the container, and a second end, the second end having an opening positioned outside the container;

a hollow collection member positioned within the container, the collection member having a first end and a second end, the first end being positioned within the container to receive liquids from within the container, the collection member second end being mated with the mating member for liquid passage through the mating member;

an extendable and flexible straw having a first end and a second end, the first end being mated with the mating member for liquid passage into the straw, the straw first end being rotatable with respect to the mating member; and a winder mechanism positioned on the container, the winder mechanism receiving the straw from the mating member, coiling the straw within the winder mechanism, and discharging the straw second end from within the winder mechanism, the winder mechanism allowing the straw to be uncoiled and extended beyond the winder mechanism, the winder mechanism having a spring for rewinding the extended straw within the winder mechanism.

2. The container of claim 1, further comprising a layer of heat insulating material attached to the container and positioned such that the material is between the container and the user when the container is belted about the user.

3. The container of claim 1, further comprising a temperature gauge attached to the container, the gauge indicating the temperature of the contained liquids.

4. The container of claim 3, wherein the temperature gauge further comprises at least two color indicators for indicating the liquid temperature.

5. The container of claim 4, wherein the number of color-coded indicators is four, the indicators comprising a red, yellow, green and blue indicator.

6. The container of claim 1, further comprising a fluid level indicator, the fluid level indicator indicating the level of the contained liquids.

7. The container of claim 1, wherein the container is constructed from a heat insulating material.

8. The container of claim 1, wherein the container further comprises a liner, the liner being impermeable with respect to liquid.

9. The container of claim 8, wherein the liner is constructed from a heat insulation material.

10. The container of claim 1, wherein the container first and second end fastening members comprise a first hook-and-loop fastener portion and a second hook-and-loop fastener portion.

11. The container of claim 1, further comprising a nozzle attached to the straw second end.

12. The container of claim 1, wherein the container further comprises a bottom portion, the collection member first end being positioned within the container bottom portion.

13. The container of claim 1, wherein the winder mechanism further comprises:

a housing the housing having an entry passage for receiving mating member second end, the housing having an exit passage for receiving the straw;

a coil spring having a first end and a second end, the first end attached to the housing; and a spool plate attached to the coil spring second end such that rotation of the spool plate winds the coil spring, the spool plate having a spool portion, the spool plate further having a passage, such that the straw is received through the spool plate passage, wound upon the spool portion, and discharged through the housing exit passage.

14. The container of claim 1, wherein:

the straw first end further comprises an enlarged portion; and the mating member further comprises an enlarged interior for receiving the straw first end enlarged portion for rotation therein.

15. A portable liquid container comprising:

an elongated, flexible container, the container having means for adding liquid within the container, and means for belting the container about the waist of the user;

means for providing liquid passage into an extendable and flexible straw, the straw being rotatable with respect to the container; and means for extending the straw to the user's mouth and retrieving and coiling the straw upon completion of use by the user.

16. The container of claim 15, further comprising means for reducing heat transfer between the container and the user's body.

17. The container of claim 15, further comprising means for measuring and communicating the temperature of the liquid within the container to the user.

18. The container of claim 15, further comprising means for communicating the amount of liquid remaining in the container to the user.

19. The container of claim 15, further comprising means for reducing heat transfer between the liquids in the container and the environment about the container.

20. The container of claim 15, further comprising means for reducing heat transfer between the liquids in the container and the container.

* * * * *